US012188340B2

(12) United States Patent
Oehring

(10) Patent No.: US 12,188,340 B2
(45) Date of Patent: Jan. 7, 2025

(54) HYDRAULIC FRACTURING OF GEOLOGICAL FORMATIONS WITH ENERGY STORAGE SYSTEM

(71) Applicant: Halliburton Energy Services, Inc., Houston, TX (US)

(72) Inventor: Jared Oehring, Cypress, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/273,493

(22) PCT Filed: Feb. 24, 2022

(86) PCT No.: PCT/US2022/017718
§ 371 (c)(1),
(2) Date: Jul. 20, 2023

(87) PCT Pub. No.: WO2022/182886
PCT Pub. Date: Sep. 1, 2022

(65) Prior Publication Data

US 2024/0318532 A1 Sep. 26, 2024

Related U.S. Application Data

(60) Provisional application No. 63/152,913, filed on Feb. 24, 2021.

(51) Int. Cl.
*E21B 43/26* (2006.01)
*E21B 41/00* (2006.01)

(52) U.S. Cl.
CPC ..... *E21B 43/2607* (2020.05); *E21B 41/0085* (2013.01)

(58) Field of Classification Search
CPC ..... E21B 43/2607
See application file for complete search history.

(56) References Cited

U.S. PATENT DOCUMENTS

2010/0038907 A1* 2/2010 Hunt ..... E21B 41/0085 290/43
2017/0030177 A1 2/2017 Oehring et al.
(Continued)

FOREIGN PATENT DOCUMENTS

WO 2020219088 A1 10/2020

OTHER PUBLICATIONS

Foreign Communication from Related Application—International Search Report and Written Opinion of the International Searching Authority, International Application No. PCT/US2022/017718, dated Feb. 24, 2023, 11 pages.

*Primary Examiner* — Matthew R Buck
(74) *Attorney, Agent, or Firm* — Conley Rose, P.C.; Rodney B. Carroll

(57) ABSTRACT

An apparatus comprises at least one energy storage system, at least one switchgear assembly configured to be attached to a utility electrical line, the at least one switchgear assembly connected to the at least one energy storage system, at least one sand source configured to house a granular material, a blender configured to mix the at least one granular material with water from a water source, the blender further configured to send the at least one granular material with water to an electric pump, the blender connected to the at least one switchgear assembly, and an electric pump configured to pump the at least one granular material with water to a wellbore, the electric pump connected to the at least one switchgear assembly.

19 Claims, 10 Drawing Sheets

(56) References Cited

U.S. PATENT DOCUMENTS

| | | | | |
|---|---|---|---|---|
| 2019/0119096 | A1 | 4/2019 | Haile et al. | |
| 2019/0316447 | A1* | 10/2019 | Oehring | F04B 49/065 |
| 2020/0300073 | A1* | 9/2020 | Hinderliter | H02B 1/24 |
| 2021/0032961 | A1* | 2/2021 | Hinderliter | E21B 43/2607 |
| 2021/0108489 | A1* | 4/2021 | Shampine | E21B 41/0085 |
| 2021/0285312 | A1* | 9/2021 | Joost | F01D 15/10 |
| 2022/0145730 | A1* | 5/2022 | Benson | H02J 3/32 |
| 2022/0162931 | A1* | 5/2022 | Zhong | E21B 43/2607 |

* cited by examiner

HYDRAULIC FRACTURING OF GEOLOGICAL FORMATIONS WITH ENERGY STORAGE SYSTEM

CROSS-REFERENCE TO RELATED APPLICATIONS

The present application is a filing under 35 U.S.C. 371 of International Application No. PCT/US2022/017718 filed Feb. 24, 2022, entitled "Hydraulic Fracturing of Geological Formations with Energy Storage System," which claims benefit of U.S. Provisional Application no. 63/152,913, filed Feb. 24, 2021, which is are incorporated herein by reference in its their entirety for all purposes.

FIELD OF THE DISCLOSURE

Aspects of the disclosure relate to hydraulic fracturing of geological formations. More specifically, aspects of the disclosure relate to both an apparatus and method to conduct hydraulic fracturing of geological formations through use of electrical based components.

BACKGROUND

Hydraulic fracturing, also called tracking, tracing, hydrofracking, fraccing, frac'ing, and hydrofracturing, is a well stimulation technique involving the fracturing of bedrock formations by a pressurized liquid. The process involves the high-pressure injection of "tracking fluid" (primarily water, containing sand or other proppants suspended with the aid of thickening agents) into a wellbore to create cracks in the deep-rock formations through which natural gas, petroleum, and brine will flow more freely. When the hydraulic pressure is removed from the well, small grains of hydraulic fracturing proppants (such as sand) hold the fractures open.

Hydraulic fracturing has been used in the hydrocarbon recovery industry for decades. Over time, regulatory bodies have overseen different aspects of the hydraulic fracturing process. According to the United States Environmental Protection Agency (EPA), one such oversight body, hydraulic fracturing is a process to stimulate a natural gas, oil, or geothermal well to maximize extraction. The EPA defines the broader process to include acquisition of source water, well construction, well stimulation, and waste disposal.

Generally, a hydraulic fracture is formed by pumping fracturing fluid into a wellbore at a rate sufficient to increase pressure at a target depth (determined by the location of the well casing perforations), to exceed that of the fracture gradient (pressure gradient) of the surrounding geological stratum. The fracture gradient is defined as pressure increase per unit of depth relative to density, and is usually measured in pounds per square inch, per square foot, or bars. The geological stratum cracks, and the fracture fluid permeates the geological stratum extending the crack further, and further, and so on. Fractures are localized as pressure drops off with the rate of frictional loss, which is relative to the distance from the well. Operators typically try to maintain "fracture width", or slow its decline following treatment, by introducing a proppant into the injected fluid—a material such as grains of sand, ceramic, or other particulate, thus preventing the fractures from closing when injection is stopped and pressure removed. Consideration of proppant strength and prevention of proppant failure becomes more important at greater depths where pressure and stresses on fractures are higher. The propped fracture is permeable enough to allow the flow of gas, oil, salt water and hydraulic fracturing fluids to the well.

The location of one or more fractures along the length of the borehole is strictly controlled by various methods that create or seal holes in the side of the wellbore. Hydraulic fracturing is performed in cased wellbores, for example, and the zones to be fractured are accessed by perforating the casing at those locations. Perforating may be accomplished by several methods, including a perforating "gun" that provides an explosive charge to a localized downhole environment, thereby disrupting the continuity of the casing for the wellbore.

Hydraulic-fracturing equipment used in oil and natural gas fields may consist of a slurry blender, one or more high-pressure, high-volume fracturing pumps (typically powerful triplex or quintuplex pumps) and a monitoring unit, also typically called a data van. Associated equipment includes tanks used to store fluid, commonly called "fracturing tanks", one or more units for storage and handling of proppant, high-pressure treating iron, a chemical additive unit (used to accurately monitor chemical addition), low-pressure flexible hoses, and many gauges and meters for flow rate, fluid density, and treating pressure. Chemical additives may be added according to the needs of the wellbore, Chemical additives, in some embodiments, are a 0.5% of the total fluid volume. As geological stratum may vary along the length of a wellbore, different capabilities for hydraulic fracturing may be present within a single wellbore. To this end, fracturing equipment may operate over a range of pressures and injection rates, and can reach up to 100 megapascals (15,000 psi) and 265 liters per second (9.4 cu ft/s) (100 barrels per minute). In some embodiments, operators seek volume injection rates of up to 120 barrels per minute or more. As easy to hydraulic fracture wellbores diminish over time, it is postulated that even greater volume injection rates will be needed.

Conventional operations use diesel engines as the prime mover for fluids. These diesel engines have many serious drawbacks. First, the horsepower needed to pump the fracturing fluids to the depths and pressures required necessitates large engines. These large diesel engines require large amounts of fuel and produce many pollutants, Operators must maintain expensive environmental permits for the use of these engines. These environmental permits may vary from geographic location to geographic location. Such restrictions on pollutants may preclude some types of diesel engines from being used in a specific location. Operators, therefore, must have numerous diesel engines to cover different possibilities that may be present in different locations. All of these requirements greatly increase the cost of service provided to a hydrocarbon recovery operation.

When permit levels for pollutants are exceeded, operators must pay fines to local, state or federal officials. Such fines may be expensive, further increasing the economic cost of performing hydrocarbon recovery operations.

Wellbore sites are also increasingly regulated for contamination spills from liquid sources as well. Diesel engines require a diesel fuel source to be pumped or supplied to the engine. As operations may continue around the clock, refueling operations may occur at all times of the day and in all weather conditions Variability of weather and time can increase the possibility of a fuel spill, requiring expensive remediation.

The continuous concerns about environmental contamination require specially trained workers to be used at the well site. Such individuals must be capable of not only running the equipment, but also trained in remediation if a spill or accident occurs. To help in these remediation efforts, materials such as absorbent booms must be used to contain contaminants. As can be seen, the amount of equipment, the cost of the equipment and the training of the people involved increases costs dramatically.

Conventional systems, moreover, do not utilize advantages that may be present at a wellsite. On some occasions, utility power may be present at the drilling site. As such, vast amounts of power may be readily available for use in fracturing operations, but are ignored as diesel engines or other technologies are used. In other instances, ample power sources exist in distant electrical microgrids that may be tapped, but again are ignored.

There is a need to provide a hydraulic fracturing system that may use existing electrical energy from a utility or from a Microgrid, rather than diesel engines or other conventional technology. There is a further need to provide an apparatus and method that may use this electrical energy efficiently, over time, when needed by operators to conduct efficient hydraulic fracturing, thereby eliminating the need to have a power generation facility at or near the wellsite location.

There is a need to provide an apparatus and method of operation of the apparatus that do not have the environmental concerns present in conventional diesel hydraulic fracturing operations.

There is a further need to provide an apparatus and method that are easier to operate than conventional apparatus, described above, thereby eliminating the need for specially trained individuals.

There is a still further need to reduce economic costs associated with hydraulic fracturing operations that are present with conventional tools and methods of operation.

There is also a need to provide a hydraulic fracturing system that eliminates the necessity of different sizes of diesel engines that operators must have in stock so that the operator has the necessary equipment to perform needed work.

There is also a need to provide a hydraulic fracturing system that is more robust than diesel engine systems and that does not have the failure rate of such crude mechanical systems.

There is also a need to provide a hydraulic fracturing system that may be easily maintained, during all times of the day, and that may be operated in varying weather conditions, without failure.

There is also a need to provide a hydraulic fracturing system that uses less personnel than conventional hydraulic fracturing systems, thereby driving economic costs downward.

SUMMARY

So that the manner in which the above recited features of the present disclosure can be understood in detail, a more particular description of the disclosure, briefly summarized below, may be had by reference to embodiments, some of which are illustrated in the drawings. It is to be noted that the drawings illustrate only typical embodiments of this disclosure and are therefore not to be considered limiting of its scope, for the disclosure may admit to other equally effective embodiments without specific recitation. Accordingly, the following summary provides just a few aspects of the description and should not be used to limit the described embodiments to a single concept.

In one example embodiment, an apparatus is disclosed. The apparatus may comprise at least one energy storage system. The apparatus may also comprise at least one switchgear assembly configured to be attached to a utility electrical line, at least one switchgear assembly connected to the at least one energy storage system. The apparatus may further comprise at least one sand source configured to house a granular material. The apparatus may further comprise a blender configured to mix the at least one granular material with water from a water source, the blender further configured to send the at least one granular material with water to an electric pump, the blender connected to the at least one switchgear assembly. The apparatus may also comprise an electric pump configured to pump the at least one granular material with water to a wellbore, the electric pump connected to the at least one switchgear assembly.

In another example embodiment, a method of conducting an electric hydraulic fracturing operation is disclosed. The method may comprise providing an electrically operated hydraulic fracturing system. The method may also comprise connecting the hydraulic fracturing system to a utility based power grid. The method may also comprise obtaining electricity from the utility based power grid. The method may also comprise performing hydraulic fracturing operations with the hydraulic fracturing system.

In another example embodiment, a method of conducting an electric hydraulic fracturing operation, is disclosed. The method comprises providing an electrically operated hydraulic fracturing system. The method further comprises connecting the electrically operated hydraulic fracturing system to a micro-power grid. The method further comprise obtaining electricity from the micro-power grid. The method further comprises performing hydraulic fracturing operations with the electric hydraulic fracturing system.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the drawings. It is to be noted, however, that the appended drawings illustrate only typical embodiments of this disclosure and are therefore not to be considered limiting of its scope, for the disclosure may admit to other equally effective embodiments.

Figure 1:
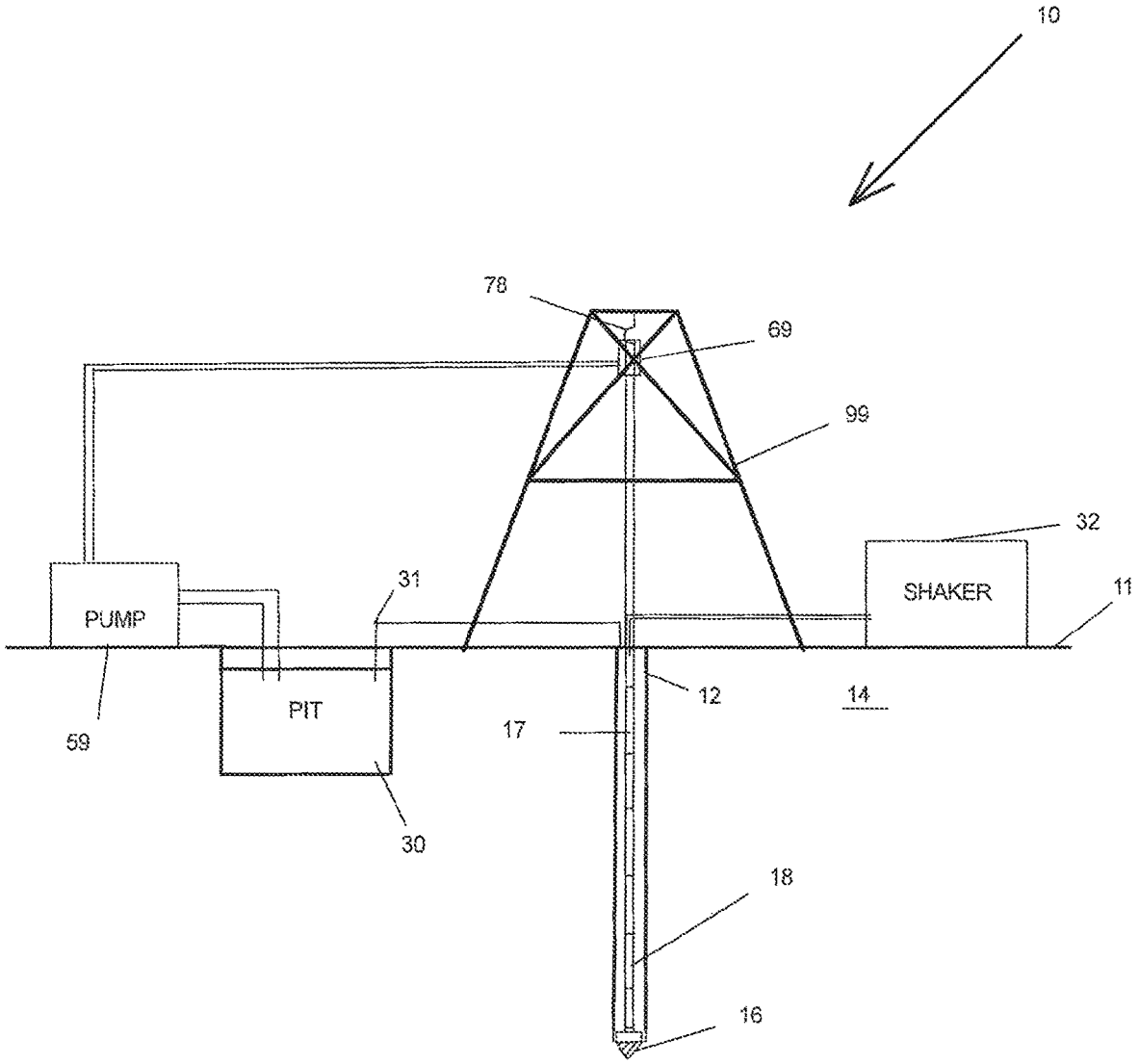
FIG. 1 is a drill rig performing a hydrocarbon recovery operation in one aspect of the disclosure.

To facilitate understanding, identical reference numerals have been used, where possible, to designate identical elements that are common to the figures ("FIGS"). It is contemplated that elements disclosed in one embodiment may be beneficially utilized on other embodiments without specific recitation.

DETAILED DESCRIPTION

In the following, reference is made to embodiments of the disclosure. It should be understood, however, that the disclosure is not limited to specific described embodiments. Instead, any combination of the following features and elements, whether related to different embodiments or not, is contemplated to implement and practice the disclosure. Furthermore, although embodiments of the disclosure may achieve advantages over other possible solutions and/or over the prior art, whether or not a particular advantage is achieved by a given embodiment is not limiting of the disclosure. Thus, the following aspects, features, embodiments and advantages are merely illustrative and are not considered elements or limitations of the claims except where explicitly recited in a claim. Likewise, reference to "the disclosure" shall not be construed as a generalization of inventive subject matter disclosed herein and should not be considered to be an element or limitation of the claims except where explicitly recited in a claim.

Although the terms first, second, third, etc., may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first", "second" and other numerical terms, when used herein, do not imply a sequence or order unless clearly indicated by the context. Thus, a first element, component, region, layer or section discussed herein could be termed a second element, component, region, layer or section without departing from the teachings of the example embodiments.

When an element or layer is referred to as being "on," "engaged to," "connected to," or "coupled to" another element or layer, it may be directly on, engaged, connected, coupled to the other element or layer, or interleaving elements or layers may be present. In contrast, when an element is referred to as being "directly on," "directly engaged to," "directly connected to," or "directly coupled to" another element or layer, there may be no interleaving elements or layers present. Other words used to describe the relationship between elements should be interpreted in a like fashion. As used herein, the term "and/or" includes any and all combinations of one or more of the associated listed terms.

Some embodiments will now be described with reference to the figures. Like elements in the various figures will be referenced with like numbers for consistency. In the following description, numerous details are set forth to provide an understanding of various embodiments and/or features. It will be understood, however, by those skilled in the art, that some embodiments may be practiced without many of these details, and that numerous variations or modifications from the described embodiments are possible. As used herein, the terms "above" and "below", "up" and "down". "upper" and "lower", "upwardly" and "downwardly", and other like terms indicating relative positions above or below a given point are used in this description to more clearly describe certain embodiments.

To acquaint the reader with hydrocarbon recovery operations, a sample process of drilling a wellbore will be discussed with reference to FIG. 1. After such drilling description, computer control equipment used in control operations for hydraulic fracturing as well as potential drilling operations will be discussed with reference to FIG. 2. The well drilled in reference to FIG. 1 may then be hydraulically fractured with equipment illustrated with equipment from FIGS. 3 through 10. A method for hydraulically fracturing a geological formation with an energy storage system is described in reference to FIG. 8. Referring to FIG. 1, a drilling rig 10 is illustrated. The purpose of the drilling rig 10 is to recover hydrocarbons located beneath the surface 11. Different stratum 14 may be encountered during the creation of a wellbore 12. In FIG. 1, a single stratum 14 layer is provided. As will be understood, multiple layers of stratum 14 may be encountered. In embodiments, the stratum 14 may be horizontal layers. In other embodiments, the stratum 14 may be vertically configured. In still further embodiments, the stratum 14 may have both horizontal and vertical layers. Stratum 14 beneath the surface 11 may be varied in composition, and may include sand, clay, silt, rock and/or combinations of these. In typical types of wellbore construction, the wellbore 12 is drilled into a shale deposit that contains trapped hydrocarbons. Through the process of hydraulic fracturing, hydrocarbons trapped within the shale deposit may be freed and recovered within the wellbore 12.

As conditions may vary within the wellbore 12, extending from portions of the wellbore 12 in shale, while other portions of the wellbore 12 being in sand, for example, operators, therefore, need to assess the composition of the stratum 14 in order to maximize penetration of a drill bit 16 that will be used in the drilling process. The wellbore 12 is formed within the stratum 14 by a drill bit 16 that is urged into the stratum 14 through pressure from a drill string 18. In embodiments, the drill string 18 is rotated such that the connected drill bit 16 is also rotated causing portions ("cuttings") of the stratum 14 to be loosened at the bottom of the wellbore 12. Differing types of drill bits 16 may be used to penetrate different types of stratum 14. The types of stratum 14 encountered, therefore, is an important characteristic for operators. The types of drill bits 16 may vary widely. In some embodiments polycrystalline diamond compact ("PDC") drill bits may be used. In other embodiments, roller cone bits, diamond impregnated or hammer bits may be used. In embodiments, during the drilling process, vibration may be placed upon the drill bit 16 to aid in the breaking of stratum 14 that are encountered by the drill bit 16. Such vibration may increase the overall rate of penetration ("ROP"), increasing the efficiency of the drilling operations.

Operators may add portions of drill string pipe 17 to form a drill string 18, thereby elongating the effective reach of the operators into the progressively increasing wellbore 12. As illustrated in FIG. 1, the drill string 18 may extend into the stratum 14 in a vertical orientation. In other embodiments, the drill string 18 and the wellbore 12 may deviate from a vertical orientation. In some embodiments, the wellbore 12 may be drilled in certain sections in a horizontal direction, parallel with the surface 11. In drilling shale deposits, for example, such deposits are generally formed in a horizontal configuration, such that a single wellbore may travel horizontally along the vein of deposits creating a long "pay zone" or area where hydrocarbons may be recovered.

Drilling fluids may be used to transport cuttings from the downhole environment to the uphole environment. To this end, pumps may be used to transport fluids to and from the wellbore. These fluids may include water and specialty chemicals to aid in the formation of the wellbore. Other additives, such as defoamers, corrosion inhibitors, alkalinity control, bactericides, emulsifiers, wetting agents, filtration reducers, flocculants, foaming agents, lubricants, pipe-freeing agents, scale inhibitors, scavengers, surfactants, temperature stabilizers, scale inhibitors, thinners, dispersants, tracers, viscosifiers, and wetting agents may be added.

The drilling fluids may be stored in a tank or a pit 30 located at the drill site. The pit 30 may have a recirculation line 31 that connects the pit 30 to a shaker 32 that is configured to process the drilling fluid after progressing from the downhole environment.

Drilling fluid from the pit 30 is pumped by a mud pump 59 that is connected to a swivel 69. The drill string 18 is suspended by a drive 78 from a derrick 99. In the illustrated embodiment, the drive 78 may be a unit that sits atop the drill string 18 and is known in the industry as a "top drive". The top drive is configured to provide the rotational motion of the drill string 18 and attached drill bit 16. Although the drill string 18 is illustrated as being rotated by a top drive 78, other configurations are possible. A rotary drive located at or near the surface 11 may be used by operators to provide the rotational force. Power for the rotary drive or the top drive may be provided by diesel generators.

Drilling fluid is provided to the drill string 18 through a swivel 69 suspended by the derrick 99. The drilling fluid exits the drill string 18 at the drill bit 16 and has several functions in the drilling process. The drilling fluid is used to cool the drill bit 16 and remove the cuttings generated by the drill bit 16. The drilling fluid with the loosened cuttings enter the annular area outside of the drill string 18 and travel up the wellbore 12 to a shaker 32. The drilling fluid provides further information on the stratum 14 being encountered and may be tested with a viscometer, for example, to determine formation properties. Such formation properties allow engineers the ability to determine if drilling should proceed or terminate.

The shaker 32 is configured to separate the cuttings from the drilling fluid. The cuttings, after separation, may be analyzed by operators to determine if the stratum 14 currently being penetrated has hydrocarbons stored within the stratum 14 level that is currently being penetrated by the drill bit 16. The drilling fluid is then recirculated to the pit 30 through the recirculation line 31. The shaker 32 separates the cuttings from the drilling fluid by providing an acceleration of the fluid on to a screening surface. As will be understood, the shaker 32 may provide a linear or cylindrical acceleration for the materials being processed through the shaker 32. In embodiments, the shaker 32 may be configured with one running speed. In other embodiments, the shaker 32 may be configured with multiple operating speeds. In embodiments, the shaker 32 may operate at multiple operating speeds.

After drilling of the wellbore, the cased wellbore must be "completed" to allow hydrocarbons to enter the wellbore from hydraulic fracturing described in FIGS. 3 through 8. Completion operations entail sending a gun or shaped charge down the wellbore to a position where hydrocarbons are expected to be present. The gun or shaped charge is detonated, thereby creating a hole in the cased wellbore. With the cased wellbore now "open" to the geological stratum, hydraulic fracturing may commence.

Embodiments of the disclosure provide for hydraulic fracturing of geological formations through use of electrical equipment. Specifically, aspects of the disclosure allow for connection of the electrical equipment to a utility service. Other aspects of the disclosure allow for connection to a microgrid, wherein the microgrid provides electrical service to a specific area around or near a website. Such configurations are different than stand alone configurations of diesel generators used in conventional apparatus.

Aspects of the entire hydraulic fracturing system may provide other sources of energy input as well. In embodiments, electrical production through the use of solar cells can be used to power various pieces of equipment for the hydraulic fracturing system or may charge individual cells or racks of cells of an energy storage system, described later.

In embodiments, a high pressure fluid is pumped to each of the wells 312, 314, 316, (See FIG. 3) wherein the high-pressure fluid exits the holes created during the completion process. This high-pressure fluid causes cracks to form in the surrounding formation. Materials with the fluid, proppants, prevent the cracks from closing. The cracks in the hydrocarbon bearing stratum allow hydrocarbons trapped within the stratum to escape and enter the lower pressure wellbore once the hydraulic fracturing fluid is removed. The result is that a constant stream of hydrocarbons travels up the wellbore to be collected by operators of the hydraulic fracturing equipment. The hydrocarbons may be in a form of a liquid, a gas or a combination of both. The hydrocarbons are gathered, according to their respective type and processed as needed for industry.

Figure 3:
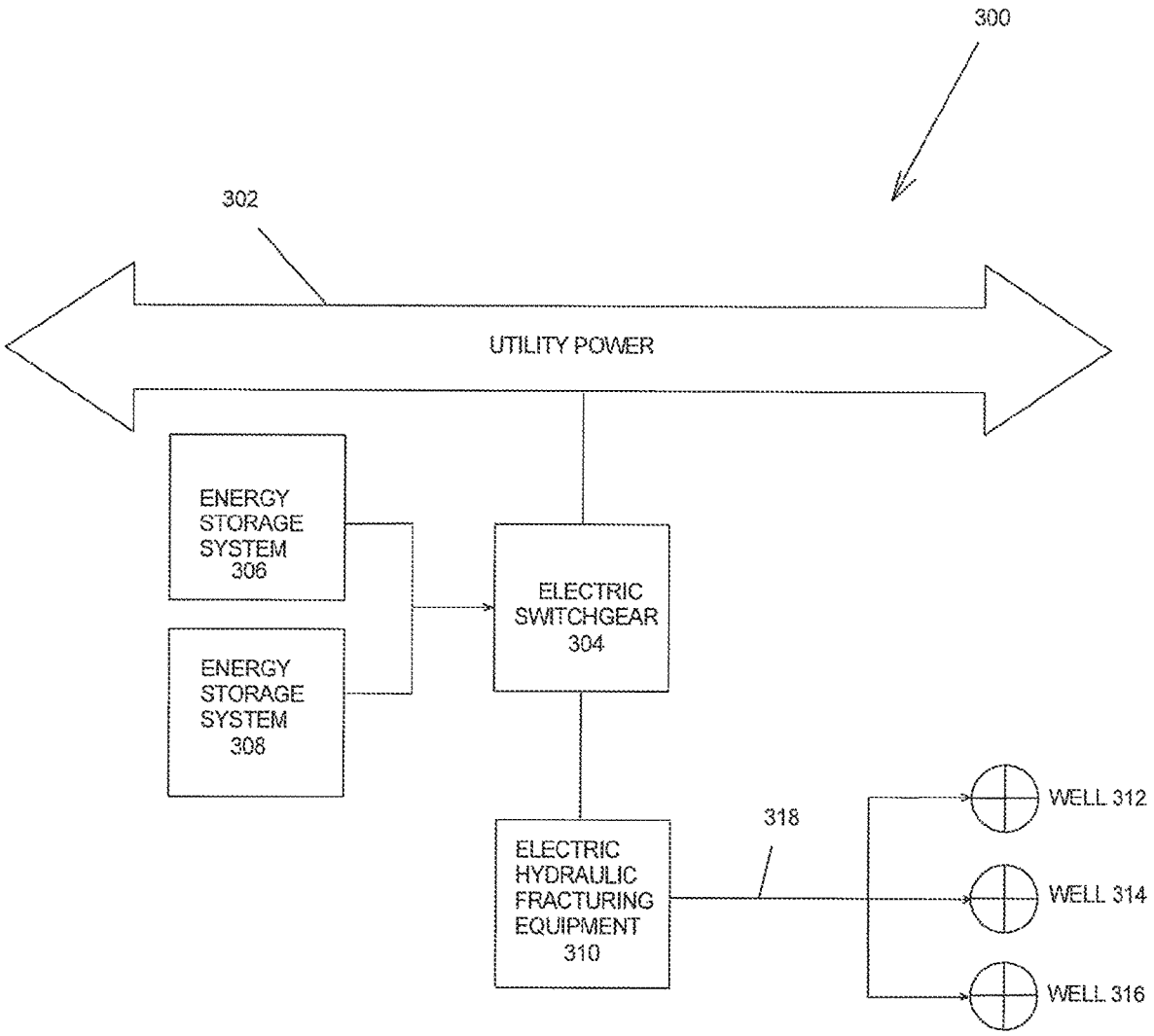
FIG. 3 is a schematic view of a first embodiment of a utility powered hydraulic fracturing system that utilizes an energy storage system to run electric hydraulic fracturing equipment.
Figure 4:
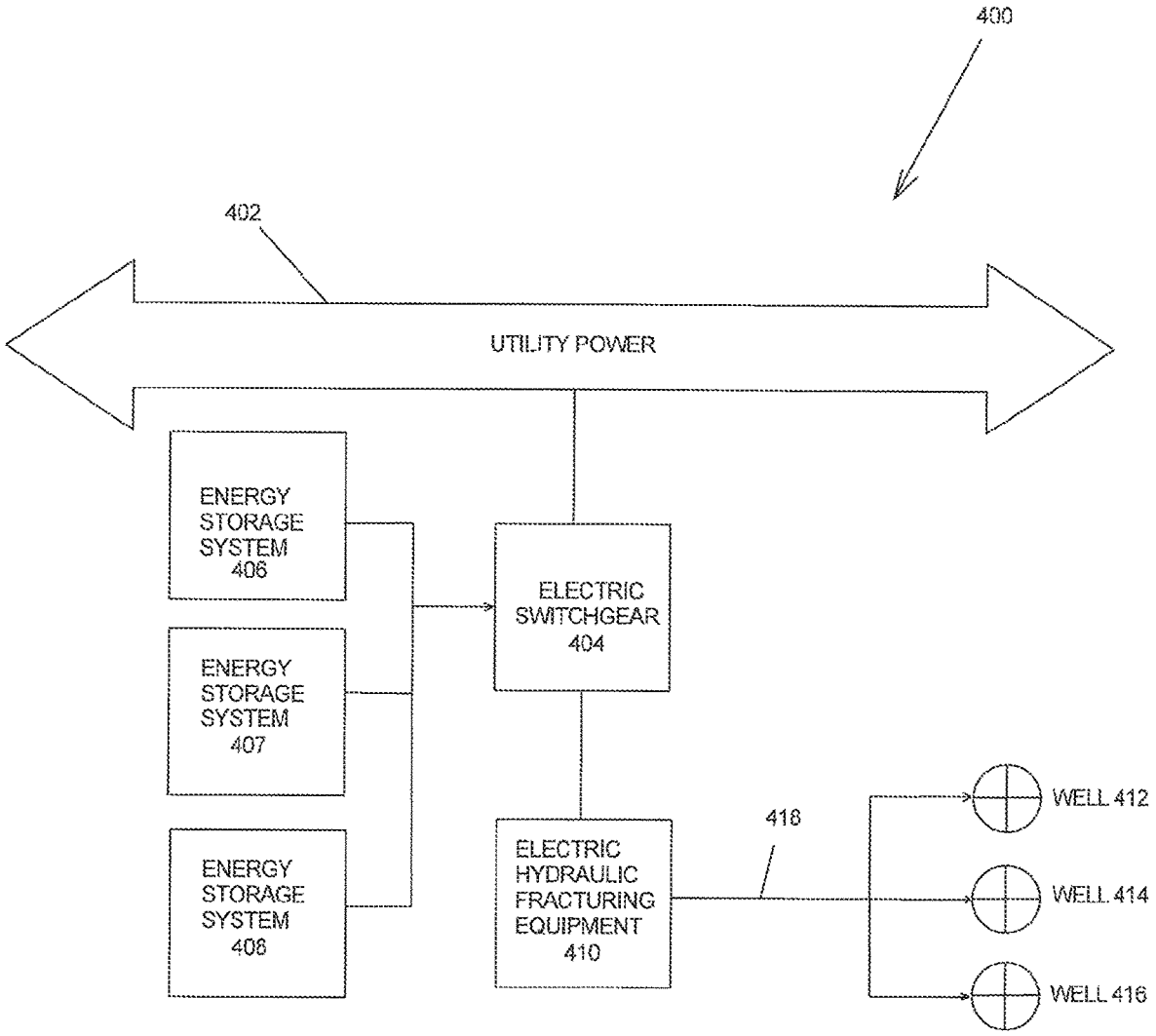
FIG. 4 is a schematic view of a second embodiment of a utility powered hydraulic fracturing system that utilizes an energy storage system to run electric hydraulic fracturing equipment.

Referring to FIG. 3, a first embodiment of a system 300 for hydraulic fracturing of geological formations with an energy storage system is illustrated. The system 300 is configured to receive electrical power from a utility power source 302. The utility power source 302 may be a high voltage line, for example, or a power feed from a substation. In the case of a high voltage line, typical example of such lines would include 13,800 V capacity. Other lines may be used, including 69,000 for "sub transmission" lines, or 345,000 V, when properly stepped down in voltage. As illustrated, electrical switchgear 304 is provided to allow for flexibility of connection to the utility power source 302. Power received may be stored in an energy storage system 306, 308. In the embodiment shown in FIG. 3, a redundant energy storage system is illustrated to allow for single failure proof design. In embodiments, more than two energy storage systems may be used, as illustrated in FIG. 4. The energy storage systems 306, 308 may be configured to both store and send electrical energy. During the process of sending electrical energy, as illustrated in FIG. 3, electrical energy is sent to the electric switchgear 304, which appropriately converts the electrical energy to the appropriate voltage and current needed to run the individual pieces of the system 300. These pieces, parts of the electric hydraulic fracturing equipment 310 has a fluid connection 318 that connects the electric hydraulic fracturing equipment 310 to wells 312, 314, 316. Although shown as three wells 312, 314, 316, other configurations are possible, including a single well. Referring to FIG. 4, as with the first example embodiment, any number of wells 412,414,416 may be serviced with the electric hydraulic fracturing equipment 410. As a result, the interconnection to three (3) wells 412, 414, 416 is merely one example of the possible interconnections. As will be understood, the number of energy storage systems 406, 407, 408 may be varied. More or less energy storage systems 406, 407, 408 may be used.

In one embodiment, some components of the system may be housed in a trailer. In embodiments, the trailer may be a single drop trailer to allow for easy transport to a well site. In one embodiment, the trailer may have a heavy-duty 25,000 lb rated axel rating. In embodiments, an air ride suspension may be used.

Figure 5:
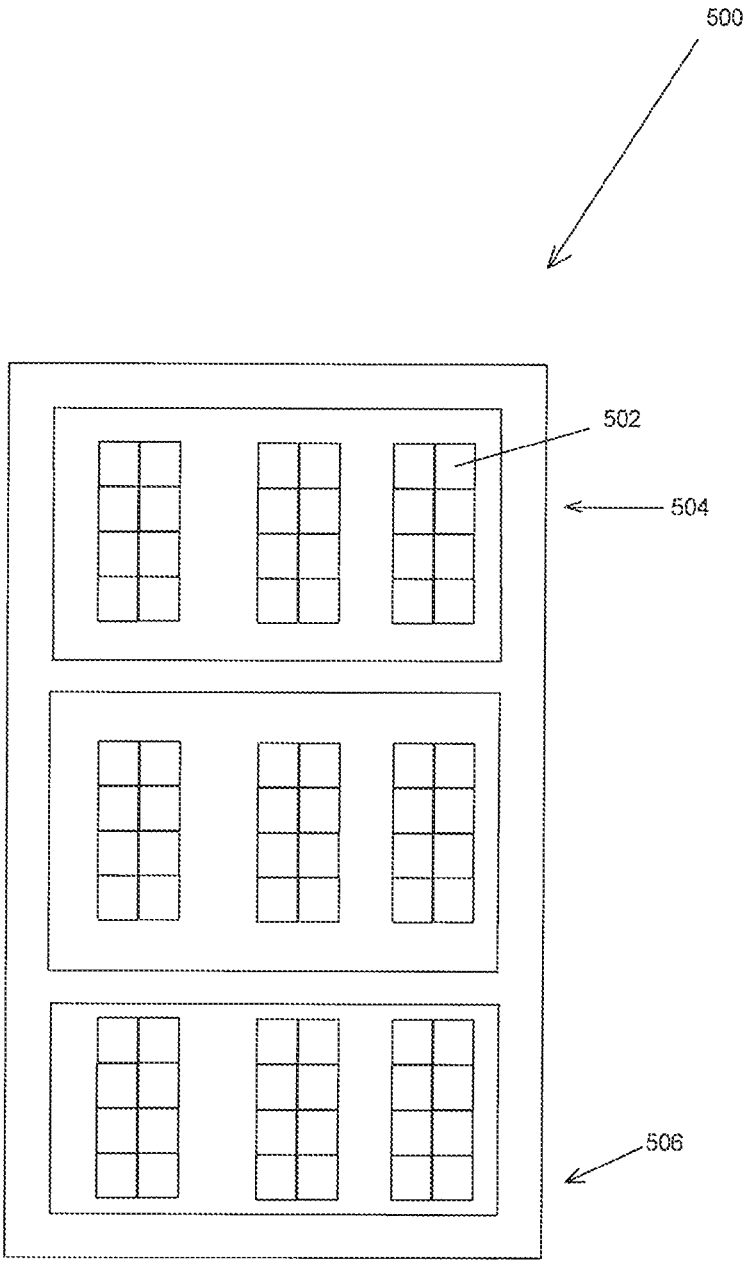
FIG. 5 is a side view of a rack system for an energy storage system used, for example, in the embodiments described related to FIG. 3 and FIG. 4.

Referring to FIG. 5, a rack system 500 used for storing batteries 502 is illustrated. The rack system 500 is configured to structurally support the batteries 502 such that the batteries 502 may be moved as a unit. Structural loading, such as lifting or transportation acceleration and deceleration may be provided for. In the illustrated embodiment, the rack 500 system allows for operators to access each battery 502 within the rack system 500. The rack system 500 has open sides 504 to allow for air flow to cool the batteries. The bottom rack portion 506 is provided such that the batteries 502 are elevated from the floor in case of a liquid being present in the environment. In the illustrated embodiment, the batteries 502 are provided in a configuration of two (2) columns and five (5) rows.

In one non-limiting embodiment, the height of the rack system 500 may be 2360 mm (7.74 feet). The depth of the rack system 500 may be 805 mm (2.64 feet) and the length of the rack system 500 may be 1140 mm (3.74 feet). In embodiments, ten (10) sections illustrated in FIG. 5 may be linked together. In embodiments, a total of 360 batteries 502 may be stored. The rack system 500 may be configured from type 6061 aluminum to allow for rigid structural support, lightness of weight and corrosion resistance. In a loaded configuration, the weight of the rack system 500 and associated batteries 502 may be 1944 kg (4,285 pounds).

In one embodiment, a battery management system is provided. The battery management system provides for remote monitoring and troubleshooting of the overall system. In embodiments, a computerized system is provided to perform monitoring and remediation steps. To this end, the computer system may provide for remote software updates. Aspects of the computer system may be shown in FIG. 2. Other aspects of the battery management system provide for cell balancing to allow for a uniform charge and voltage provided by the batteries. The battery management system is also configured with sensors, such as temperature sensors. The temperature sensors may be configured such that temperature readings are sent to the computer system. Data may be obtained, analyzed and stored by the computer system. Other sensors may be provided, including the capability to monitor, analyze and record individual cell voltages, state of charge and state of health. The battery management system may also be configured to provide error reporting on a cell, pack or system basis. The battery management system is further configured to provide real time current, voltage and capacity monitoring and reporting capability. Aspects of the battery management system may be configured with a system to determine contactor failure. Further aspects of the battery management system provide for a high voltage interlock loop monitoring capability.

Figure 6:
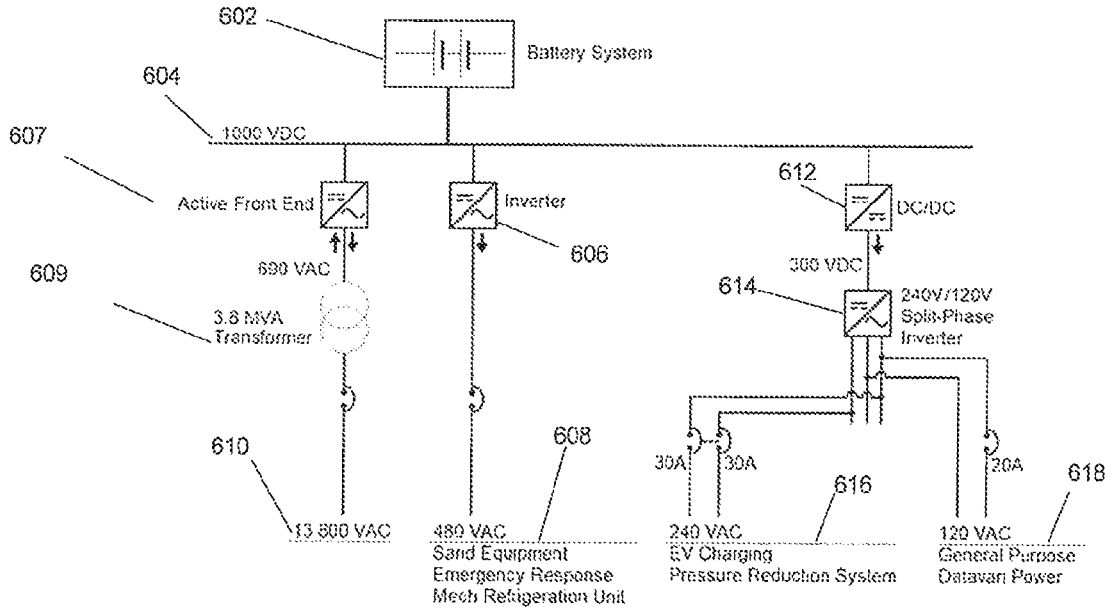
FIG. 6 is an electrical schematic of an interconnected battery system, power feed line and selected portions of the hydraulic fracturing system with one example embodiment of the disclosure.

Referring to FIG. 6, an electrical schematic of an interconnected battery system, power feed line and selected portions of the hydraulic fracturing system with one example embodiment of the disclosure is illustrated. A battery system 602 is connected to a 1000 volt DC line 604. The 1000 volt DC line 604 is connected to a 13,600 volt alternating current line 610, which may be a transmission line to a utility line. A 3.6 MVA transformer 609 is positioned between an active front end/inverter 607 and the 13,600 volt alternating current line 610 to allow for electrical energy transformation between direct current and alternating current.

Further referring to FIG. 6, a second inverter 606 is provided between the 1000 volt direct current line 604 and a 480 volt alternating current line 608 that is connected to various components of the hydraulic fracturing system. Such connections may be, for example, controlling sand equipment used for proppants used downhole, emergency response operations and refrigeration units used in various locations.

Further referring to FIG. 6, a third connection to the 1000 volt direct current line 604 allows for general purpose power 618 and electric vehicle charging 616. To this end, a third inverter 612 followed by a split-phase inverter 614 are positioned between the electric vehicle charging portion 616 and the general purpose 120 volt alternating current connection 618. As will be understood, charging for two electric vehicles 616 are provided with 240 volt single phase 50 amp capabilities.

In embodiments, a solar collection system may be used to assist with hydraulic fracturing activities. The solar cell collection system may have a nominal bus voltage of approximately 966 volts (direct current). Output current may be 3000 amperes. For an entire solar collection system, the installed energy may be 2.9 MWh. Batteries used with the solar collection system may be protected by a battery thermal management system. In one embodiment, a liquid cooled system is used. In another embodiment, an air-cooled system may be used. In embodiments, the battery chemistry may be Lithium NMC type batteries.

The energy storage system illustrated in FIG. 3 and FIG. 4, is described in more detail. The energy storage system (406, 407, 408) is provided as a battery storage system. The battery storage system is housed by the battery rack 500 and is configured to provide energy to hydraulic fracturing equipment on demand. The battery storage system is provided with several features to enable the safe provision of energy. In embodiments, the battery storage system is provided with a system to prevent thermal runaway from occurring. The thermal runaway system is configured to not only prevent thermal runaway between cells, but also as a system as a whole.

The battery storage system is provided with a fire prevention system. Fire prevention is provided by choosing high quality battery cells as well as providing insulation between cells. Battery cells used, in embodiments, are thermally and vibration tested. In some embodiments, battery cells are shock tested. Acceleration levels for shock testing may be up to, for example, 150 g. In further embodiments, an external short circuit test is performed on cells. One such external short circuit test may provide for shorting the cells with a resistance of less than 0.1 ohms for at least one hour.

Other tests for battery cells may also be accomplished. In embodiments, an impact/crush test may be performed on cells. For example, a crush force in excess of 10 kN may be exerted on to the exterior of the cell. Other safety tests may include a capability to withstand overcharge. For example, a charge rate may be exerted upon the cell at twice the manufacturer's recommended maximum rate. In embodiments, a forced discharge test conducted on cells may also be performed. In one embodiment, the forced discharge test may be performed at a maximum discharge current rate as rated by a cell manufacturer.

At a module level, in order to prevent fire propagation, construction provides for cell spacing to limit heat transfer.

In some embodiments, intra-cell thermal insulation is used to block heat transfer. In some embodiments, a thermal management system interface is created to remove heat from the system.

In embodiments, the thermal management system is provided to keep cells within a specific temperature range. To this end, the thermal management system is capable of cooling and heating the battery cells.

Figure 7:
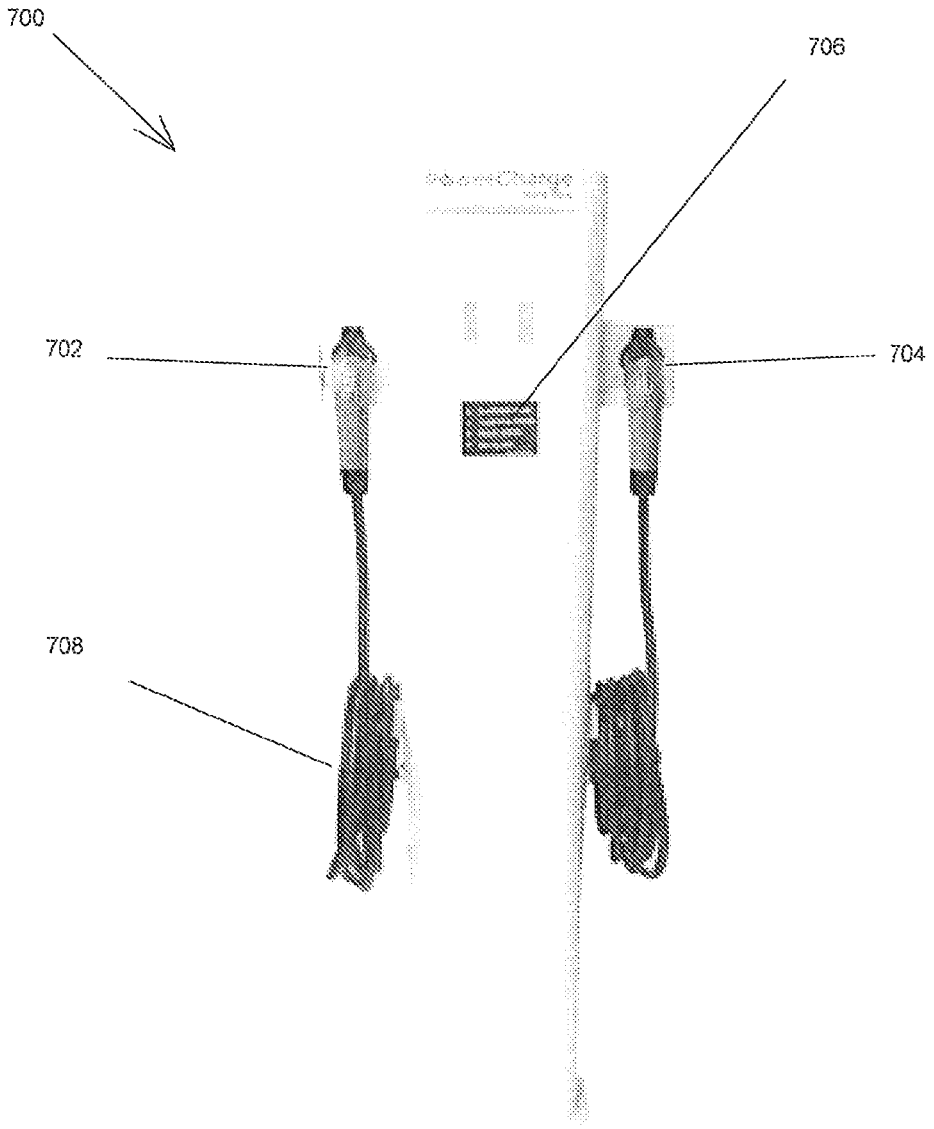
FIG. 7 is a side view of an electric vehicle charging station used in one example embodiment of the disclosure.

Referring to FIG. 7, a sample electric charging station 700 used in conjunction with the electric vehicle charging portion 616 described in FIG. 6 is illustrated. The electric charging station 700 may be used to charge electric vehicles for various purposes. As an example, electrical energy may be obtained from a utility, as previously described.

The electrical energy may be stored within an energy storage system, as described in relation to FIG. 3 or FIG. 4, as non-limiting embodiments. The electric charging station 700 may have a dual-port 702, 704 pedestal configuration. In the illustrated embodiment, the input to the electric charging station 700 may be 208 or 240 Volts alternating current. Output current may be 16 amperes, 30 amperes or 40 amperes. The output current may be selectable through a user interface 706. The user interface 706 may be a touchscreen display. In embodiments, the touchscreen may be color.

Output charging power may also be selectable by a user. Non-limiting example embodiments may include 3.3 kW, 7.2 kW and 9.6 kW power output levels. An output charging cable 708 may be provided. In one embodiment, the output charging cable 708 may be 18 feet long. Other lengths may be used.

The electric charging station 700 may also have a ground fault detection system to prevent accidental discharge of electricity.

Figure 8:
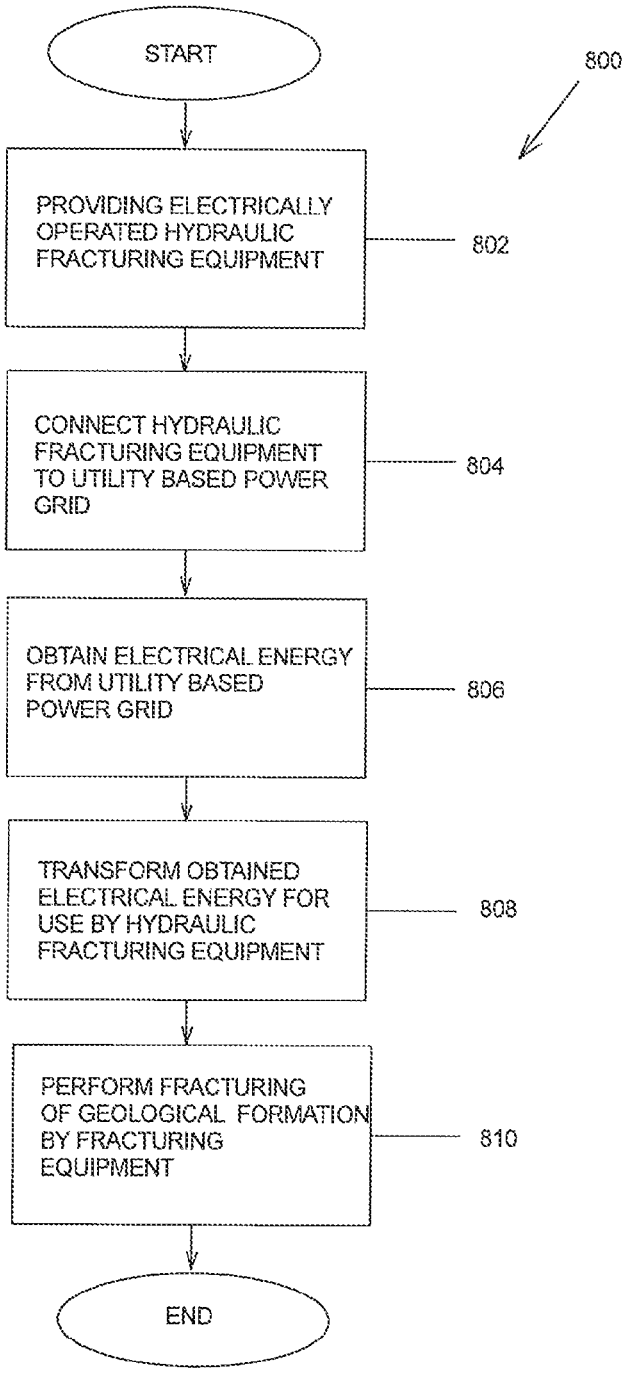
FIG. 8 is a method of hydraulic fracturing of a geological formation with an energy storage system in one example embodiment of the disclosure.

Referring to FIG. 8, a method 800 for hydraulically fracturing a geological stratum is illustrated. The method 800 may include, at 802 providing an electrically operated hydraulic fracturing system at a wellbore. At 804, the method continues as connecting hydraulic fracturing equipment to a utility-based power grid. At 806, the method continues to provide obtaining electrical energy from the utility-based power grid. At 808, the method provides with transforming the obtained electrical energy for use by hydraulic fracturing equipment. At 810, the method continues with performing fracturing operations of a geological formation by hydraulic fracturing equipment.

Figure 9:
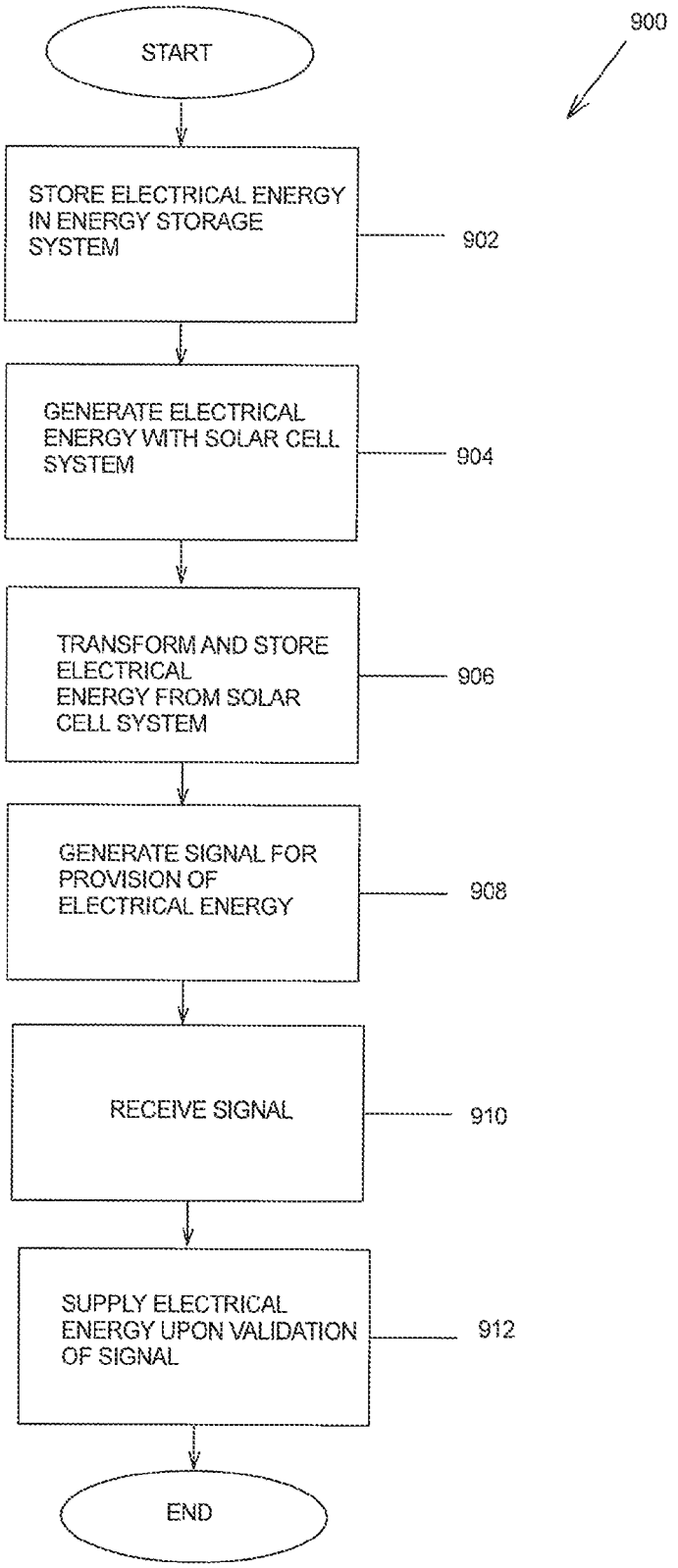
FIG. 9 is a method of operations for the method of hydraulic fracturing of FIG. 8.

Referring to FIG. 9, method steps for individual step 806 are illustrated. At 806, the method recites obtaining electrical energy from the utility-based power grid. Steps 902 through 912 further define that the electrical energy obtained may be stored, at 902, in an energy storage system, as described in relation to FIG. 3 or FIG. 4, as non-limiting embodiments. In embodiments, electrical energy may be generated through a solar cell system, at 904. At 906, the electrical energy generated through the solar cell system may be transformed and then stored within the electrical energy system. As will be understood, production of electrical energy through the solar cell system is optional. At 908, a signal for provision of electrical energy is generated by a user who wishes to use hydraulic fracturing equipment. At 910, the signal is received at a control system for the energy storage system. At 912, upon validation of the signal, electrical energy is supplied by the energy storage system to equipment used to transform the electrical energy, as specified at step 808.

Figure 2:
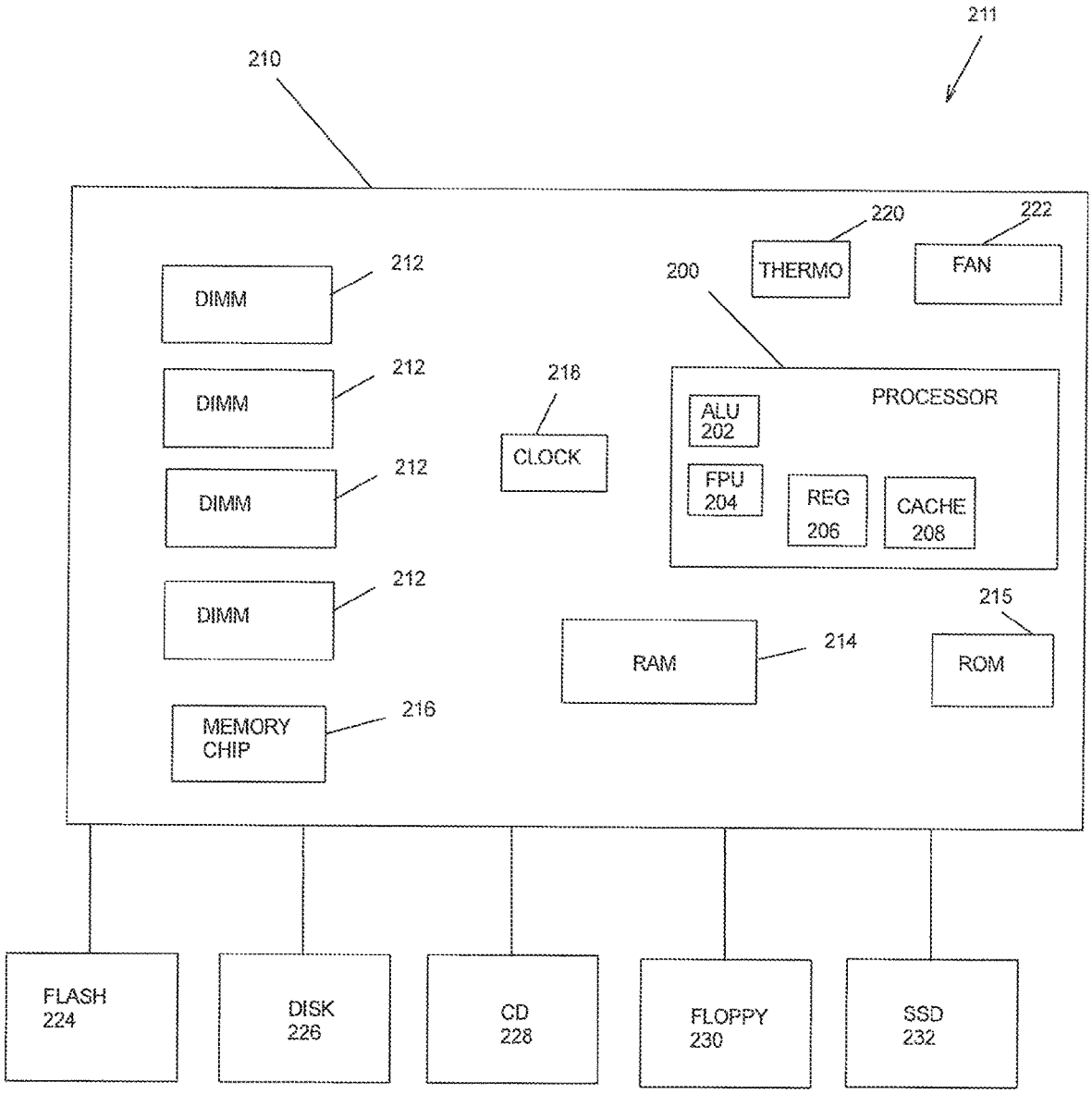
FIG. 2 is a computer apparatus used in performing methods and controlling apparatus for the operations of FIG. 1.
Figure 10:
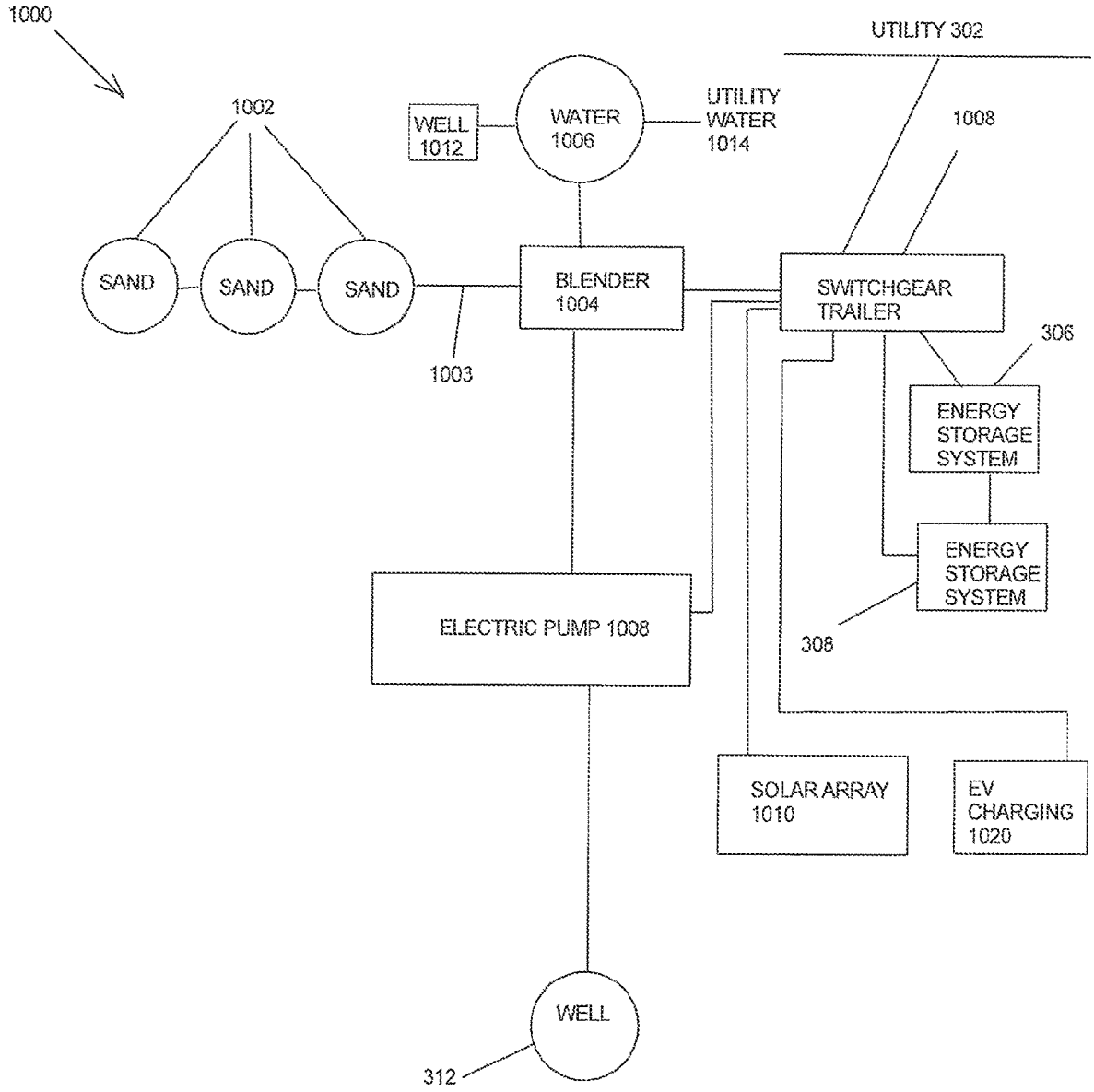
FIG. 10 is a detailed layout of a system in accordance with one example embodiment of the disclosure.

Referring to FIG. 10, a system 1000 used for electric hydraulic fracturing with a utility interconnect is described. The system 1000 has at least one sand source 1002 that houses sand materials for hydraulic fracturing. In the illustrated embodiment, there are three sand sources 1002. The sand sources 1002 may be tanks, for example, that house sand and prevent unforeseen hydration. A granular moving system 1003 conducts sand from the sand sources 1002 to a blender 1004. The granular moving system 1003 may be, for example, a conveyor system. The blender 1004 is also connected to a water source 1006. The blender 1004 is configured to mix granular materials from the sand sources 1002 with water 1006 such that a proper mixture is created for pumping downhole. The water source 1006 may be connected to a well 1012 and/or a utility water source 1014. After the blender 1004, the combination of water and sand is provided to an electric pump 1008, which provides sufficient motive force to the water/sand combination to fracture a geological feature/stratum in the well 312. An energy storage system 306, 308 stores and provides electrical energy obtained from a utility line 302 transferred through a switchgear trailer 1008. The switchgear trailer 1008 allows for transformation of electrical energy to the desired electrical power characteristics for the blender 1004, electric pump 1008, sand moving system 1003 and associated control equipment. An electric vehicle charging system 1020 is also connected to the switchgear trailer 1008 allowing electric vehicles a recharging capability. A solar array 1010 is also provided to allow for charging of the energy storage system 306, 308, Referring to FIG. 2, a computing apparatus used in the control of equipment of embodiments of the disclosure, as described above, is shown. In FIG. 2, a processor 200 is provided to perform computational analysis for instructions provided. The instruction provided, code, may be written to achieve the desired goal and the processor may access the instructions. In other embodiments, the instructions may be provided directly to the processor 200.

In other embodiments, other components may be substituted for generalized processors. These specifically designed components, known as application specific integrated circuits ("ASICs") are specially designed to perform the desired task. As such, the ASIC's generally have a smaller footprint than generalized computer processors. The ASIC's, when used in embodiments of the disclosure, may use field programmable gate array technology, that allows a user to make variations in computing, as necessary. Thus, the methods described herein are not specifically held to a precise embodiment, rather alterations of the programming may be achieved through these configurations.

In embodiments, when equipped with a processor 200, the processor 200 may have arithmetic logic unit ("ALU") 202, a floating point unit ("FPU") 204, registers 206 and a single or multiple layer cache 208, The arithmetic logic unit 202 may perform arithmetic functions as well as logic functions. The floating point unit 204 may be math coprocessor or numeric coprocessor to manipulate numbers more efficiently and quickly than other types of circuits. The registers 206 are configured to store data that will be used by the processor 200 during calculations and supply operands to the arithmetic logic unit 202 and store the result of operations. The single or multiple layer caches 208 are provided as a storehouse for data to help in calculation speed by preventing the processor 200 from continually accessing random access memory ("RAM") 214.

Aspects of the disclosure provide for the use of a single processor 200. Other embodiments of the disclosure allow the use of more than a single processor. Such configurations may be called a multi-core processor where different functions are conducted by different processors to aid in calculation speed. In embodiments, when different processors are used, calculations may be performed simultaneously by different processors, a process known as parallel processing.

The processor 200 may be located on a motherboard 210. The motherboard 210 is a printed circuit board that incorporates the processor 200 as well as other components helpful in processing, such as memory modules ("DIMMS") 212, random access memory 214, read only memory 215, non-volatile memory chips 216, a clock generator 218 that keeps components in synchronization, as well as connectors for connecting other components to the motherboard 210, The motherboard 210 may have different sizes according to the needs of the computer architect. To this end, the different sizes, known as form factors, may vary from sizes from a cellular telephone size to a desktop personal computer size. The motherboard 210 may also provide other services to aid in functioning of the processor 200, such as cooling capacity, Cooling capacity may include a thermometer 220 and a temperature-controlled fan 222 that conveys cooling air over the motherboard 210 to reduce temperature.

Data stored for execution by the processor 200 may be stored in several locations, including the random access memory 214, read only memory 215, flash memory 224, computer hard disk drives 226, compact disks 228, floppy disks 230 and solid state drives 232. For booting purposes, data may be stored in an integrated chip called an EEPROM, that is accessed during start-up of the processor 200. The data, known as a Basic Input/Output System ("BIOS"), contains, in some example embodiments, an operating system that controls both internal and peripheral components. A Read Only Memory 215 is provided for booting purposes when the motherboard 210 is used in a computer, for example.

Different components may be added to the motherboard or may be connected to the motherboard to enhance processing. Examples of such connections of peripheral components may be video input/output sockets, storage configurations (such as hard disks, solid state disks, or access to cloud based storage), printer communication ports, enhanced video processors, additional random access memory and network cards.

The processor and motherboard may be provided in a discrete form factor, such as personal computer, cellular telephone, tablet, personal digital assistant or other component. The processor and motherboard may be connected to other such similar computing arrangement in networked form Data may be exchanged between different sections of the network to enhance desired outputs. The network may be a public computing network or may be a secured network where only authorized users or devices may be allowed access.

As will be understood, method steps for completion may be stored in the random access memory, read only memory, flash memory, computer hard disk drives, compact disks, floppy disks and solid state drives.

Different input/output devices may be used in conjunction with the motherboard and processor. Input of data may be through a keyboard, voice, Universal Serial Bus ("USB") device, mouse, pen, stylus, Firewire, video camera, light pen, joystick, trackball, scanner, bar code reader and touch screen. Output devices may include monitors, printers, headphones, plotters, televisions, speakers and projectors.

Embodiments of the disclosure provide an apparatus and method of operation of the apparatus that do not have the environmental concerns present in conventional diesel hydraulic fracturing operations.

Embodiments of the disclosure provide an apparatus and method that are easier to operate than conventional apparatus, described above, thereby eliminating the need for specially trained individuals.

Embodiments of the disclosure reduce economic costs associated with hydraulic fracturing operations that are present with conventional tools and methods of operation.

Embodiments of the disclosure provide a hydraulic fracturing system that eliminates the necessity of different sizes of diesel engines that operators must have in stock so that the operator has the necessary equipment to perform needed work.

Embodiments of the disclosure provide a hydraulic fracturing system that is more robust than diesel engine systems and that does not have the failure rate of such crude mechanical systems Embodiments of the disclosure provide a hydraulic fracturing system that is more easily maintained, during all times of the day, and that may be operated in varying weather conditions, without failure.

Embodiments of the disclosure provide a hydraulic fracturing system that uses less personnel than conventional hydraulic fracturing systems, thereby driving economic costs downward.

In one example embodiment, an apparatus is disclosed. The apparatus may comprise at least one energy storage system. The apparatus may also comprise at least one switchgear assembly configured to be attached to a utility electrical line, at least one switchgear assembly connected to the at least one energy storage system. The apparatus may further comprise at least one sand source configured to house a granular material. The apparatus may further comprise a blender configured to mix the at least one granular material with water from a water source, the blender further configured to send the at least one granular material with water to an electric pump, the blender connected to the at least one switchgear assembly. The apparatus may also comprise an electric pump configured to pump the at least one granular material with water to a wellbore, the electric pump connected to the at least one switchgear assembly.

In another example embodiment, the apparatus may be configured wherein the at least one switchgear assembly is configured on a trailer.

In another example embodiment, the apparatus may be configured wherein the at least one energy storage system is two energy storage systems.

In another example embodiment, the apparatus may further comprise a granular moving system configured to move granular material to the blender, the granular moving system connected to the at least one switchgear assembly.

In another example embodiment, the apparatus may be configured wherein the granular moving system is configured as a conveyor.

In another example embodiment, the apparatus may further comprise at least one solar array connected to the at least one switchgear assembly.

In another example embodiment, the apparatus may further comprise an electric vehicle charging station connected to the at least one switchgear.

In another example embodiment, the apparatus may be configured wherein the at least one energy storage system is configured with a battery system.

In another example embodiment, the apparatus may further comprise a battery management system connected to the battery system, the battery management system configured to manage at least one property of the battery system.

In another example embodiment, a method of conducting an electric hydraulic fracturing operation. The method may comprise providing an electrically operated hydraulic fracturing system. The method may also comprise connecting the hydraulic fracturing system to a utility based power grid. The method may also comprise obtaining electricity from the utility based power grid. The method may also comprise performing hydraulic fracturing operations with the hydraulic fracturing system.

In another example embodiment, the method may further comprise transforming the obtained electricity from the utility based power grid prior to performing the hydraulic fracturing operation.

In another example embodiment, the method may further comprise storing the electricity in an energy storage system, prior to performing the hydraulic fracturing operations.

In another example embodiment, the method may further comprise generating electricity through a solar cell system prior to performing the hydraulic fracturing operations.

In another example embodiment, the method may further comprise transforming the electricity generated by the solar cell system prior to storing the electricity in the energy storage system.

In another example embodiment, a method of conducting an electric hydraulic fracturing operation, is disclosed. The method comprises providing an electrically operated hydraulic fracturing system. The method further comprises connecting the electrically operated hydraulic fracturing system to a micro-power grid. The method further comprise obtaining electricity from the micro-power grid. The method further comprise performing hydraulic fracturing operations with the electrically hydraulic fracturing system.

In another example embodiment, the method may further comprise transforming the obtained electricity from the micro-power grid prior to performing the hydraulic fracturing operation.

In another example embodiment, the method may further comprise storing the electricity in an energy storage system, prior to performing the hydraulic fracturing operations.

In another example embodiment, the method may further comprise generating electricity through a solar cell system prior to performing the hydraulic fracturing operations.

In another example embodiment, the method may further comprise transforming the electricity generated by the solar cell system prior to storing the electricity in the energy storage system.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may be varied in many ways. Such variations are not to be regarded as a departure from the disclosure, and all such modifications are intended to be included within the scope of the disclosure.

While embodiments have been described herein, those skilled in the art, having benefit of this disclosure, will appreciate that other embodiments are envisioned that do not depart from the inventive scope. Accordingly, the scope of the present claims or any subsequent claims shall not be unduly limited by the description of the embodiments described herein.

What is claimed is:

1. An apparatus, comprising:

at least one energy storage system;

an electric vehicle charging station;

at least one switchgear assembly configured to be attached to a utility electrical line, wherein the at least one switchgear assembly is connected to the at least one energy storage system and the electric vehicle changing station;

at least one sand source configured to house a granular material;

a blender configured to mix the granular material with water from a water source, and send the granular material with water to an electric pump, and wherein the blender is connected to the at least one switchgear assembly; and an electric pump configured to pump the at least one-granular material with water to a wellbore, wherein the electric pump is connected to the at least one switchgear assembly.

2. The apparatus according to claim 1, wherein the at least one switchgear assembly is disposed on a trailer.

3. The apparatus according to claim 1, wherein the at least one energy storage system is comprises two energy storage systems.

4. The apparatus according to claim 1, further comprising:

a granular moving system configured to move granular material to the blender, wherein the granular moving system is connected to the at least one switchgear assembly.

5. The apparatus according to claim 4, wherein the granular moving system comprises a conveyor.

6. The apparatus according to claim 1, further comprising:

at least one solar array connected to the at least one switchgear assembly.

7. The apparatus according to claim 1, wherein the at least one energy storage system comprises a battery system.

8. The apparatus according to claim 7, further comprising:

a battery management system connected to the battery system, wherein the battery management system is configured to manage at least one property of the battery system.

9. The apparatus according to claim 1, wherein the at least one switchgear assembly is connected to the at least one energy storage system via a split-phase inverter.

10. A method of hydraulic fracturing, comprising:

providing an electrically operated hydraulic fracturing system comprising a switchgear assembly, a pump connected to the switchgear assembly, and an electric vehicle charging station connected to the switchgear assembly;

connecting the switchgear assembly to a utility based power grid;

obtaining electricity from the utility based power grid;

charging an electric vehicle using the electric vehicle charging station; and performing a hydraulic fracturing operation using pump.

11. The method according to claim 10, further comprising:

transforming the obtained electricity from the utility based power grid prior to the performing of the hydraulic fracturing operation.

12. The method according to claim 10, further comprising:

storing the electricity in an energy storage system, prior to the performing of the hydraulic fracturing operation.

13. The method according to claim 12, further comprising:

generating electricity through a solar cell system prior to the performing of the hydraulic fracturing operation.

14. The method according to claim 13, further comprising:

transforming the electricity generated by the solar cell system prior to the storing of the electricity in the energy storage system.

15. A method of conducting an electric hydraulic fracturing-operation, comprising:

providing an electrically operated hydraulic fracturing system comprising a switchgear assembly, a pump connected to the switchgear assembly, and an electric vehicle charging station connected to the switchgear assembly;

connecting the switchgear assembly to a micro-power grid;

obtaining electricity from the micro-power grid;

charging an electric vehicle using the electric vehicle charging station; and performing a hydraulic fracturing operation using the pump.

16. The method according to claim 15, further comprising:

transforming the obtained electricity from the micro-power grid prior to the performing of the hydraulic fracturing operation.

17. The method according to claim 15, further comprising:

storing the electricity in an energy storage system, prior to the performing of the hydraulic fracturing operation.

18. The method according to claim 17, further comprising:

generating electricity through a solar cell system prior to the performing of the hydraulic fracturing operation.

19. The method according to claim 18, further comprising:

transforming the electricity generated by the solar cell system prior to the storing of the electricity in the energy storage system.

* * * * *